United States Patent [19]

Grieger et al.

[11] 4,101,746

[45] Jul. 18, 1978

[54] APPARATUS FOR CONTROLLING THE DRIVE FOR HYDRAULICALLY ACTUATED HIGH-VOLTAGE POWER CIRCUIT BREAKERS

[75] Inventors: Gerhard Grieger; Joaquin Bohrdt, both of Berlin, Fed. Rep. of Germany

[73] Assignee: Siemens Aktiengesellschaft, Munich, Fed. Rep. of Germany

[21] Appl. No.: 723,204

[22] Filed: Sep. 14, 1976

[30] Foreign Application Priority Data

Sep. 25, 1975 [DE] Fed. Rep. of Germany ..... 2543107

[51] Int. Cl.[2] ..... H01H 35/38

[52] U.S. Cl. ..... 200/82 B; 200/148 F; 200/308; 200/81.5

[58] Field of Search ..... 307/118; 200/82 R, 82 B, 200/81.4, 81.5, 48 R, 308, 337, 148 F

[56] References Cited

U.S. PATENT DOCUMENTS

| | | | |
|---|---|---|---|
| 2,849,627 | 8/1958 | Rigert | 200/148 F |
| 3,083,277 | 3/1963 | Tsutsui | 200/82 B |
| 3,606,764 | 9/1971 | Yokouchi | 200/81.4 |

*Primary Examiner*—Gerald P. Tolin

*Attorney, Agent, or Firm*—Kenyon & Kenyon, Reilly, Carr & Chapin

[57] ABSTRACT

Apparatus for controlling the drive for an hydraulically actuated high voltage power circuit breaker is disclosed. More particularly, the apparatus includes a number of position signal transmitter means each associated with a different one of the circuit breaker contact units. These means are each connected to respective freewheel clutches which are connected to the actuating member of a control switch means. The latter switch means is constructed so that it provides off commands to the breaker units only when all the transmitter means connected thereto are in an on or off position. The switch means is also continuously biased toward an off condition with the force of an energy accumulator.

6 Claims, 5 Drawing Figures

APPARATUS FOR CONTROLLING THE DRIVE FOR HYDRAULICALLY ACTUATED HIGH-VOLTAGE POWER CIRCUIT BREAKERS

BACKGROUND OF THE INVENTION

1. Field of the Invention

The invention relates to apparatus for controlling the drive of an hydraulically actuated high-voltage power circuit breaker having individual pole actuators designed for short interruptions and an hydraulically actuated position signal transmitter for each breaker contact unit at high-voltage potential.

2. Description of the Prior Art

For switching capacitive currents, synchronism in the order of a few milliseconds of the switching actions of all breaker contact units of a high- voltage power circuit breaker is required. Due to unavoidable manufacturing tolerances and different friction losses in the drive mechanisms and in the breaker units, mechanical synchronism of the order required can be obtained only a great expense. Moreover, even in the latter case, in an "on-off" switching operation, performed with three breaker units, the tolerance-related, different switching times mentioned still add up to an undesirable amount.

It is therefore an object of the present invention to provide increased switching reliability and, in particular, to maintain the switching time tolerance within predetermined limits in the above-described circuit breaker.

SUMMARY OF THE INVENTION

In accordance with the principles of the present invention, the above and other objectives are accomplished in a circuit breaker of the above type by further including therein as part of the control of the drive of the breaker, a freewheel clutch for each position signal transmitter means and a control switch having an actuating member connected to each transmitter via its respective freewheel clutch. The control switch is connected in series with the position transmitters and designed to transmit an off command only when all the transmitters are transferred into an on or off position. The control switch is further continuously loaded or biased towards an off condition by the force of an energy accumulator which acts upon the actuating member.

With the control for the drive of the breaker designed as aforesaid the control processes an off command effectively only when the pole of the breaker switching last has fully reached its on or off position. Even an "off" command given during the closing motion is thereby suppressed until the last pole has reached its end position.

In the illustrative embodiment of the invention to be disclosed hereinbelow, each of the position signal transmitters is an hydraulic transmitter with a differential piston, the small area side of which is pressure-loaded continuously and the large area side of which can be acted upon at will by the pressure of the hydraulic fluid.

Further, in the disclosed embodiment, the control switch is acted upon by a force which is smaller than the force due to the difference of the piston areas of each of the differential pistons of the position signal transmitters. Also, the position signal transmitters as well as the control switch have electrical indicating contacts which are arranged in the control circuit of the high-voltage power circuit breaker.

It is, particularly, advantageous if the position signal transmitters actuate optical (visual) indicating elements to make the switch position of each breaker unit of the electrical high-voltage power circuit breaker visible. In the embodiment disclosed, the actuating member for the control switch comprises a rotating shaft with cranks for each signal transmitter.

BRIEF DESCRIPTION OF THE DRAWINGS

The above and other features and aspects of the present invention will become apparent upon reading the following detailed description in conjunction with the accompanying drawings, in which.

DETAILED DESCRIPTION

Figure 1:
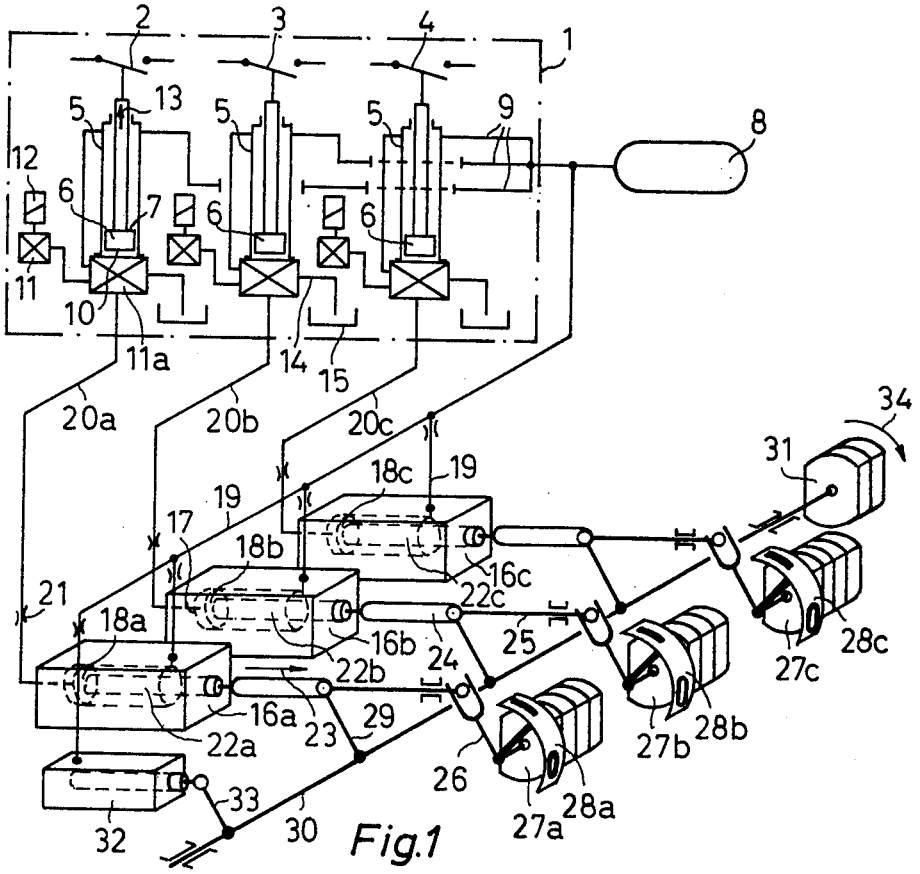
FIGS. 1 and 2 show a circuit breaker control apparatus in its on and off position, respectively, in accordance with the principles of the present invention.

FIG. 1 shows schematically an electric high-voltage power circuit breaker 1 in accordance with the principles of the present invention. As shown, the circuit breaker 1 comprises hydraulically actuated breaker units, shown schematically as breaker contacts 2, 3 and 4, which connect to the phases R, S and T, respectively of a three-phase network. For actuating the contacts 2, 3 and 4 three similarly configured hydraulic actuators 5 are provided. Each of the actuators 5 has a differential piston 6 whose small-area side 7 is loaded continuously with a hydraulic fluid stored in a high-pressure accumulator 8 and carried to the piston via the pipe lines 9. The large area side 10 of each piston 6 in turn, is either acted upon by the pressure of the hydraulic fluid stored in the accumulator 8, or is pressure relieved. The latter is accomplished by the servo valves 11 which are operated by electromagnetic control devices 12 and control the main valves **11*a* connected to the actuators 5**.

To close the electric power circuit breaker 1, an electrical signal is applied to the control devices 12, whereby pressure is admitted to the large area side 10 of each differential piston 6 via the servo valves 11 and main valves **11*a*. The pistons 6 are thereby moved in the direction of the arrow 13. To open the breaker 1 the large area side 10 of each piston 6 is pressure relieved, and the hydraulic fluid is conducted via a pipe line 14 into a respective collecting vessel 15**.

The above control permits opening and closing of all switching contacts 2, 3 and 4, as well as single contact control.

For indirectly controlling the drive, hydraulically operated transmitters **16*a*, *b* and *c* are also provided for the breakers 1. The transmitters 16*a*, 16*b* and 16*c*, are associated with the breaker contacts 2, 3, and 4, respectively, and each transmitter includes a differential piston 17, which is acted upon on its small area side continuously by the pressure of the hydraulic fluid delivered from the accumulator 8 via the line 19**.

If the drive for the switching contact 2 is moved in the closing direction, a control line **20*a* is fed fluid under pressure which is communicated via an optionally adjustable choke 21 to the large area side 18*a* of the piston 17 in the position signal transmitter 16*a*. This causes the piston rod 22*a* to move in the direction of the arrow 23. The latter piston rod in turn, is rigidly coupled to a freewheel clutch 24 which is rigidly connected to an actuating rod 25. The actuating rod 25 is moved by the piston rod 22*a*** in the same direction as the piston rod 22*a* and operates crank 26. The crank 26 controls an indicating switch 27*a* and an optical indicating element 28*a*.

In a similar manner, movement of the drive for the contacts 3 and 4 of the breaker 1 causes a similar operation to occur with respect to these contacts. In particular, such movement causes fluid to move through the control lines 20*b* and 20*c* and to actuate the piston rods 22*b* and 22*c* in the signal transmitters 16*b*, 16*c*. The latter piston rods, in turn, actuate respective actuating rods 25 via the freewheel clutches 24. The actuating rods 25, in turn, are coupled to cranks 26 which control the indicating switches 25*b* and 25*c* and optical indicating elements 28*b* and 28*c* of indicating elements 28*b* and 28*c*.

Each freewheel clutch 24 cooperates with a respective crank 29 which is fastened in a torsionally stiff manner to the shaft 30. The shaft 30 serves as the drive member of a control switch 31. An energy accumulator 32 is also connected to the shaft 30. As shown, accumulator 32 comprises a continuously pressure loaded piston cylinder system which cooperates with a crank 33, the latter being coupled in a torsionally stiff manner to the rotating shaft 30. Alternatively, a spring may also be used for the accumulator 32.

Figure 2:
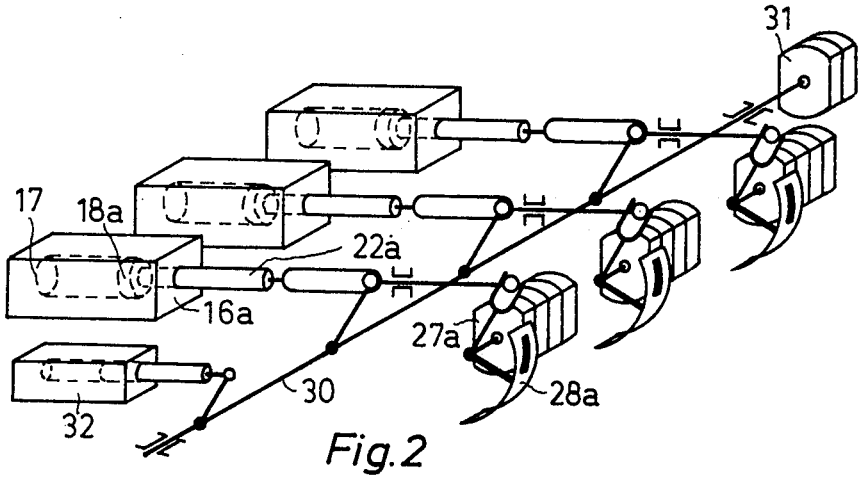

The control switch 31 which is acted upon continuously in the off direction (arrow direction 34), by the force of the accumulator 32, transmits a given "off" command only if all position signal transmitters 16*a*, 16*b* and 16*c* are transferred into the on or off position. This may be seen in FIG. 2. As shown, the force which continuously acts upon the control switch 31, is smaller than the force provided by each differential piston 17 due to the difference of the piston areas. Only when the last switching device 2 or 3 or 4 has reached the "on" position completely, can the force of the energy accumulator 32 thereby become effective for actuating the control switch 31.

The control switch 31 has two paralled-connected contacts 31*a* and 31*b* which are designed as break and make contacts and are adjusted so that the parallel connection of both contacts conducts current only in one of the two end positions of the switch 31.

Figure 3:
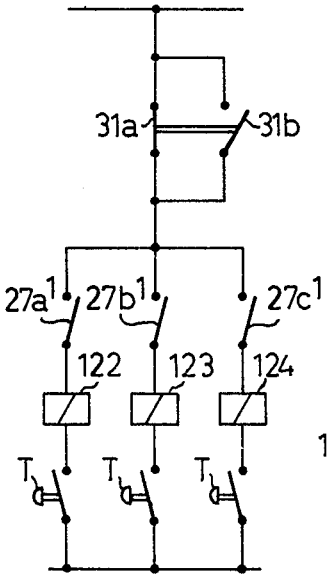
FIGS. 3, 4 and 5 show circuit diagrams for the apparatus of FIGS. 1 and 2.

FIG. 3 shows the open position of the power circuit breaker 1. In the position, which corresponds to FIG. 1, the contact 31*a* of the control switch 31 is closed, while its contact 31*b* is open. The parallel connection of the two contacts 31*a* and 31*b* feeds the contacts $27a^1$, $27b^1$, and $27c^1$ of the indicating contacts 27*a, b, c* which lead to the windings 122, 123 and 124 of the actuating devices 12 for the switching contacts 2, 3 and 4. For controlling an off command, the schematically shown keys T are provided. In the position shown, actuation does not occur when the keys are closed in accordance with a given "off" command, as the breaker, as assumed, is already open.

Figure 4:
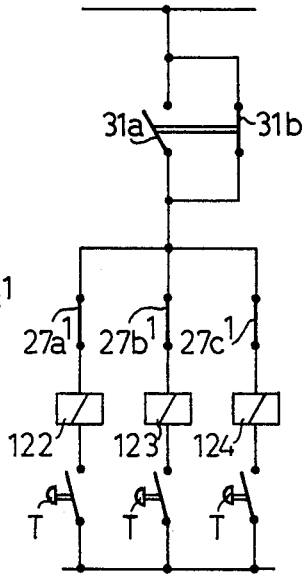

In the on position, as shown in FIG. 4, the contacts 31*b*, $27a^1$, $27b^1$ and $27c^1$ are closed so that the corresponding switching contacts 2, 3 or 4 of the power circuit breaker 1 can be opened when one of the keys T is operated.

Figure 5:
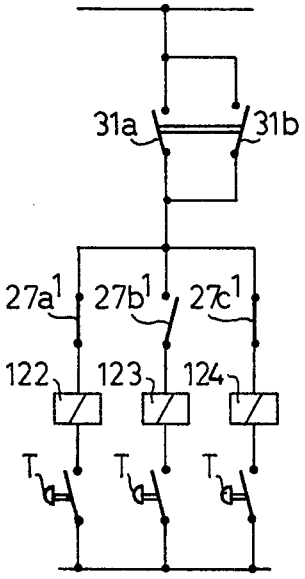

Assuming that in the course of a single pole short interruption action the power breaker pole or contact 3 is just being reclosed from the opening phase but its contact is not yet completely closed as shown in FIG. 5, the "off" command from the keys T does not become effective if the other breaker poles or contacts 2 and 4 are closed as the contacts 31*a* and 31*b* are both open. The "off" command can, therefore, become effective only when all the breakers poles are in the closed position.

What is claimed is:

1. Control apparatus for controlling the drive of a high voltage circuit breaker including a number of hydraulically actuated circuit breaker units, said control apparatus comprising:

a number of hydraulically actuated position signal transmitter means each including means adapted to be connected to a different circuit breaker unit;

a number of freewheel clutches each connected to a different one of said signal transmitter means;

control switch means responsive to each said signal transmitter means for permitting transmission of an off command to a breaker unit only when all of said signal transmitter means are in an on position or an off position, said switch means being connected in series with each said transmitter means and including an actuating means connected to said clutches;

and accumulator means for continuously loading said switch means with a force which acts to bias said switch means in the off direction.

2. A control apparatus in accordance with claim 1 in which:

each said transmitter means includes a differential piston the small area side of which is adapted to be continuously pressure loaded and the large area side of which is adapted to be pressured loaded at predetermined times.

3. Apparatus in accordance with claim 2 in which:

the force provided by the accumulator is less than the force defined by the difference between the large and small side areas of each said differential piston.

4. Apparatus in accordance with claim 1 in which:

said switch means has contacts arranged in each said breaker unit;

and each said position signal transmitter has contacts arranged in its respective breaker unit.

5. Apparatus in accordance with claim 1 further including:

optical indicating elements each being responsive to a different position indicating transmitter means.

6. Apparatus in accordance with claim 1 in which:

said actuating means include a rotating shift having a number of crank means each connected to a different transmitter means.

* * * * *